United States Patent [19]

Minshall et al.

[11] Patent Number: 4,764,333

[45] Date of Patent: Aug. 16, 1988

[54] END CLOSURES FOR CONTAINERS

[75] Inventors: David Minshall; Roy Randle, both of Warrington, England

[73] Assignee: British Nuclear Fuels plc, Warrington, England

[21] Appl. No.: 926,560

[22] Filed: Nov. 4, 1986

[30] Foreign Application Priority Data

May 22, 1985 [GB] United Kingdom ..... 8512964

[51] Int. Cl.[4] ..... G21F 5/00

[52] U.S. Cl. ..... 376/203; 376/272; 220/345

[58] Field of Search ..... 220/345, 346, 351, 329, 220/331; 250/506.1; 376/203, 272

[56] References Cited

U.S. PATENT DOCUMENTS 2,338,192 1/1944 Martin ..... 220/346

2,682,351 6/1954 Durand et al. ..... 220/331

4,576,779 3/1986 McWilliam et al. ..... 376/203

*Primary Examiner*—Deborah L. Kyle

*Assistant Examiner*—Richard L. Klein

*Attorney, Agent, or Firm*—William R. Hinds

[57] ABSTRACT

An end closure for a nuclear fuel flask in which the gate, which is movable between open and closed positions across an end of the flask, has first and second portions which are urged apart, conveniently by spring-loaded means. A door has upper and lower wedge-shaped members mounted on and releasably connected to the respective gate portions. In use, a displacement of the gate into or out of its fully closed position effects movement of one only of the gate portions and its associated door member. As the door members are wedge-shaped the other door member is urged into or out of sealing engagement with the end of the fuel flask.

5 Claims, 6 Drawing Sheets

END CLOSURES FOR CONTAINERS

The present invention concerns end closures for containers, in particular end closures for nuclear fuel transport flasks.

BACKGROUND OF THE INVENTION

One form of flask for the transport of nuclear fuel comprises a vessel having a removable closure member at one end. The flask accommodates a bottle or magazine containing the fuel and the flask is emptied by setting in an upright position with the removable closure member at its lower end whereby upon removal of the closure member the bottle or magazine can be lowered out of the flask. As the fuel within the bottle or magazine is submerged in water which can leak out of the bottle it is necessary as a safety feature to ensure that the end closure member effect a liquid tight seal at the end of the flask.

It has been proposed to utilise a wedge-shaped member to effect a seal whereby lateral movement of the wedge-shaped member across the end of the flask causes an initial vertical displacement of the end closure member to break the seal at the end of the flask. This has the advantage of reducing damage to the seal by a tearing action which could arise if the closure member was moved laterally across the end of the flask seal face without any initial separation. However the use of a single wedge-shaped member results in an end closure member of a non-uniform thickness.

FEATURES AND ASPECTS OF THE INVENTION

According to the present invention there is provided an end closure for a container, in particular an end closure for a nuclear fuel transport flask, comprising a gate movable between open and closed positions across an end of the flask, the gate having first and second portions continuously urged apart, a door releasably mounted on the gate and sealingly engageable with an opening in the end of the flask, the door having upper and lower cooperable wedge-shaped members releasably mounted on the first and second gate portions respectively for movement therewith between the open and closed positions, the assembly being arranged such that a lateral displacement of the gate into or out of its fully closed position effects movement of the second gate portion only and corresponding movement of the associated lower wedge-shaped door member, with the first gate portion and its associated upper wedge-shaped door member remaining stationary whereby to effect a vertical displacement of the upper wedge-shaped door member into or out of sealing engagement with the opening in the end of the fuel flask.

DESCRIPTION OF THE DRAWINGS

The invention will be described further, by way of example, with reference to the accompanying drawings; in which.

DESCRIPTION OF THE PREFERRED EMBODIMENT

Figure 1:
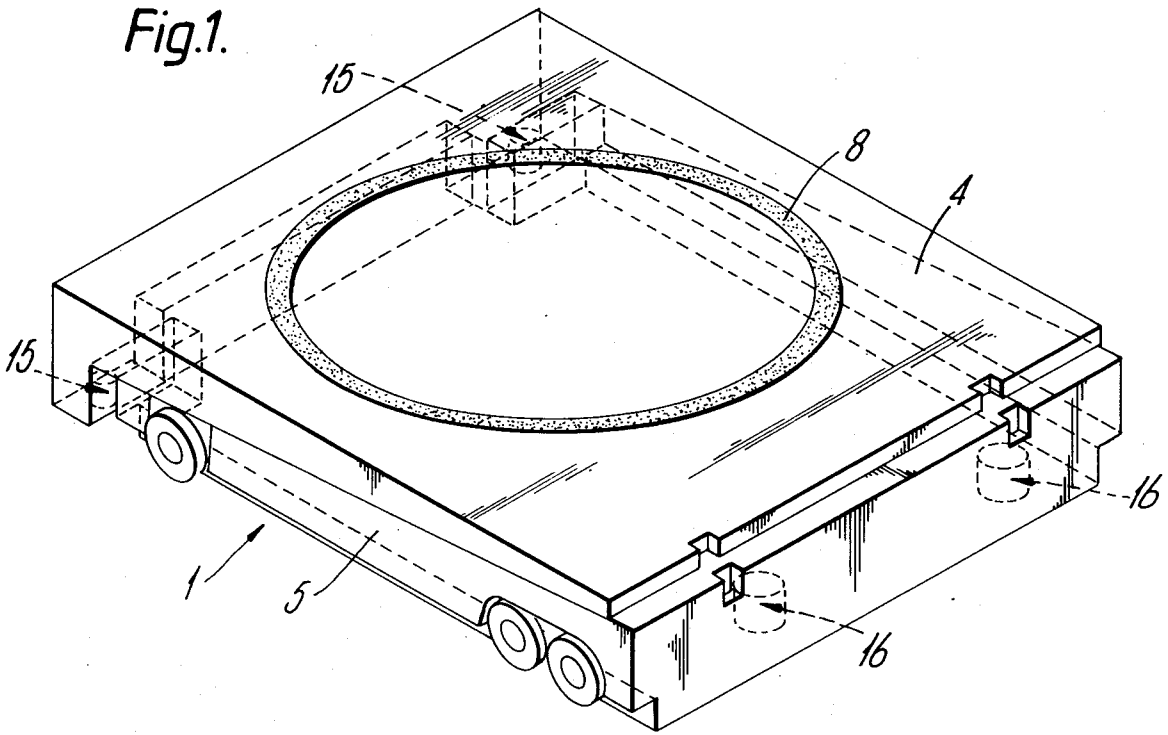
FIG. 1 is an isometric view of a flask door.
Figure 2:
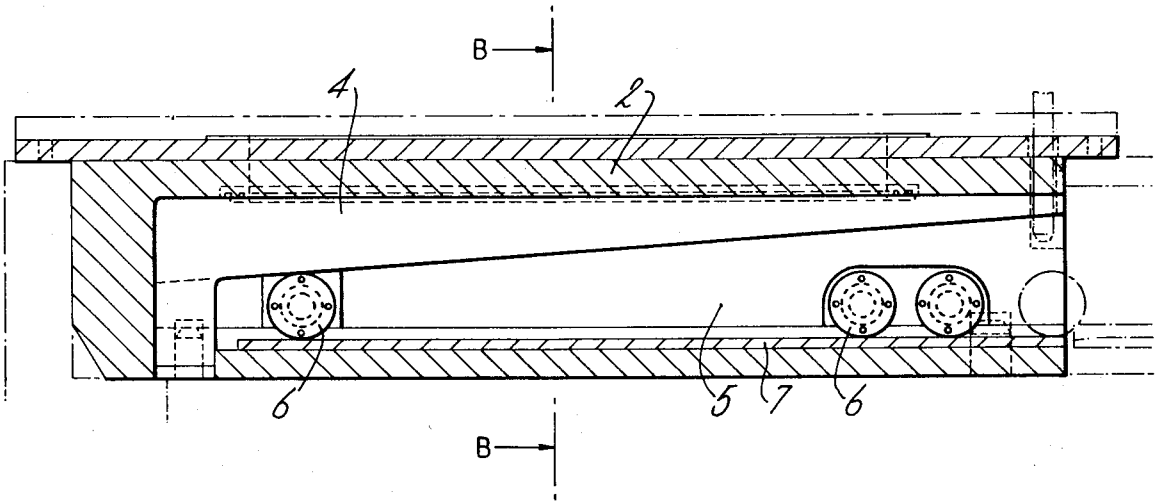
FIG. 2 is a section showing the door mounted in a flask base.
Figure 3:
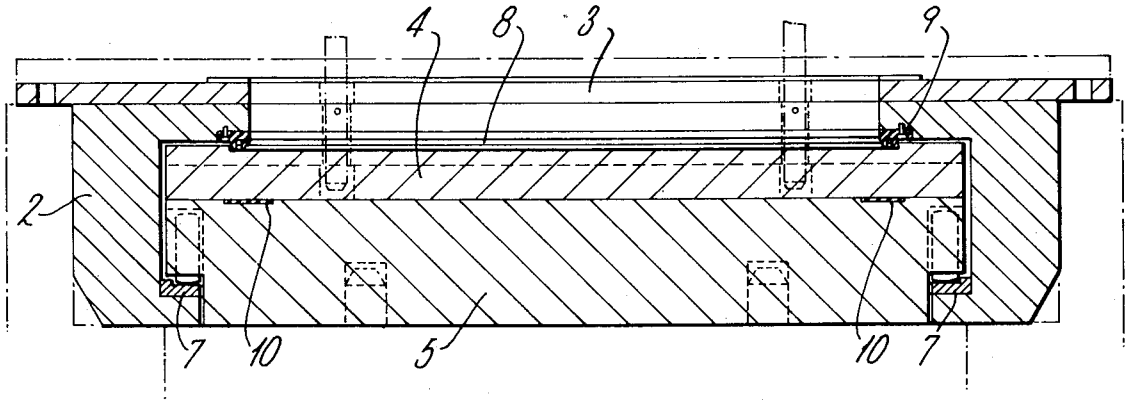
FIG. 3 is a section on B—B in FIG. 2.

With reference to FIGS. 1 to 3, a flask door 1 is mounted in a flask base 2 which, in turn, is secured to an end of a flask body (not shown). In the position illustrated in FIGS. 2 and 3 the door 1 closes an opening in the base 2 and through which contents of the flask can be discharged.

The door 1 comprises complementary upper and lower wedge-shaped members 4 and 5 respectively which together form a door of substantially uniform thickness which is received in the flask base 2. The lower member 5 is provided with wheels or rollers 6 which run on rails 7 located on inwardly directed flanges on side walls of the flask base. The upper member 4 carries a continuous seal which cooperates with a sealing ring 9 which is secured in the base and about the opening 3. To assist sliding movement between the wedge-shaped members 4 and 5, bearing strips 10 are provided in the upper surface of the lower member 5 to engage the lower surface of the upper member 4.

Figure 4:
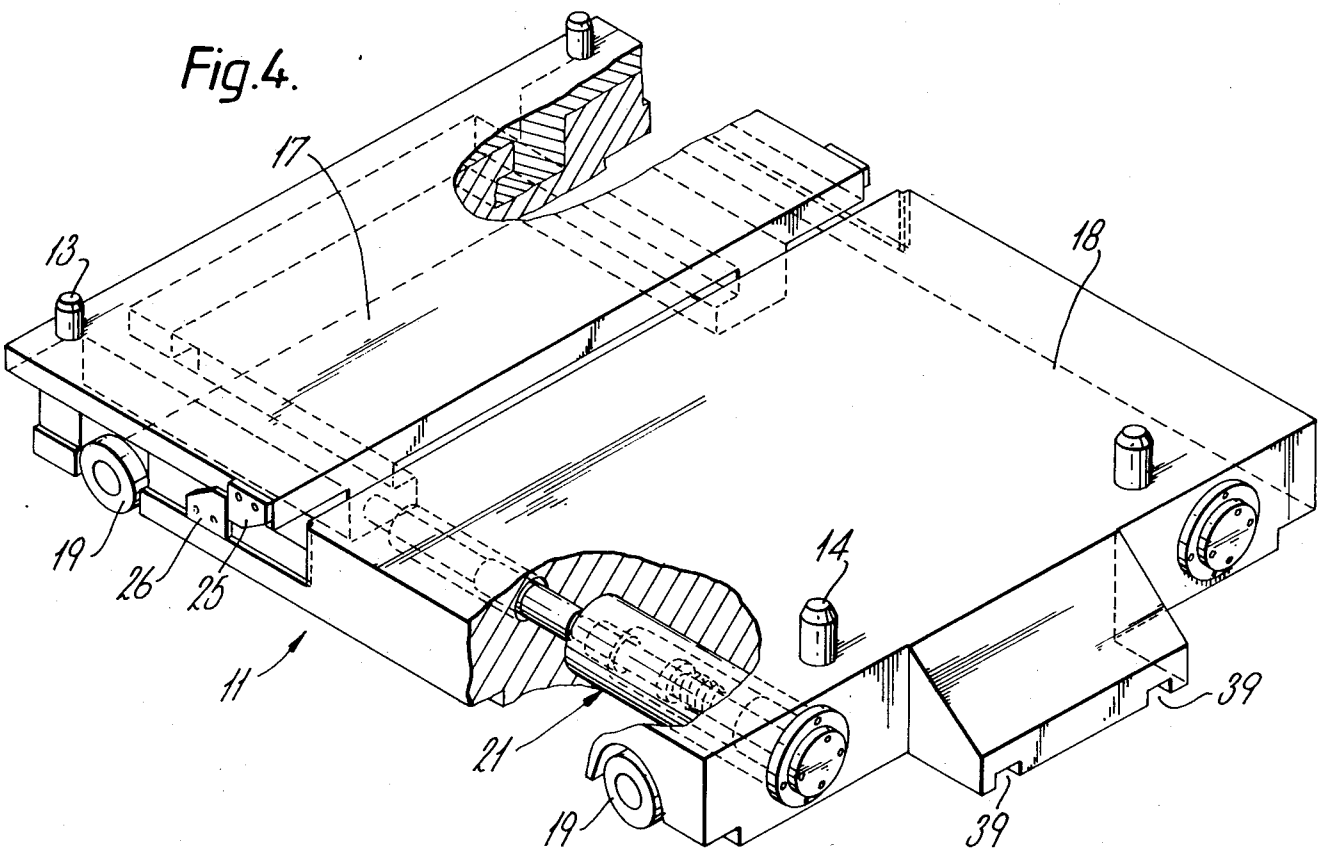
FIG. 4 is an isometric view of a gate.
Figure 5:
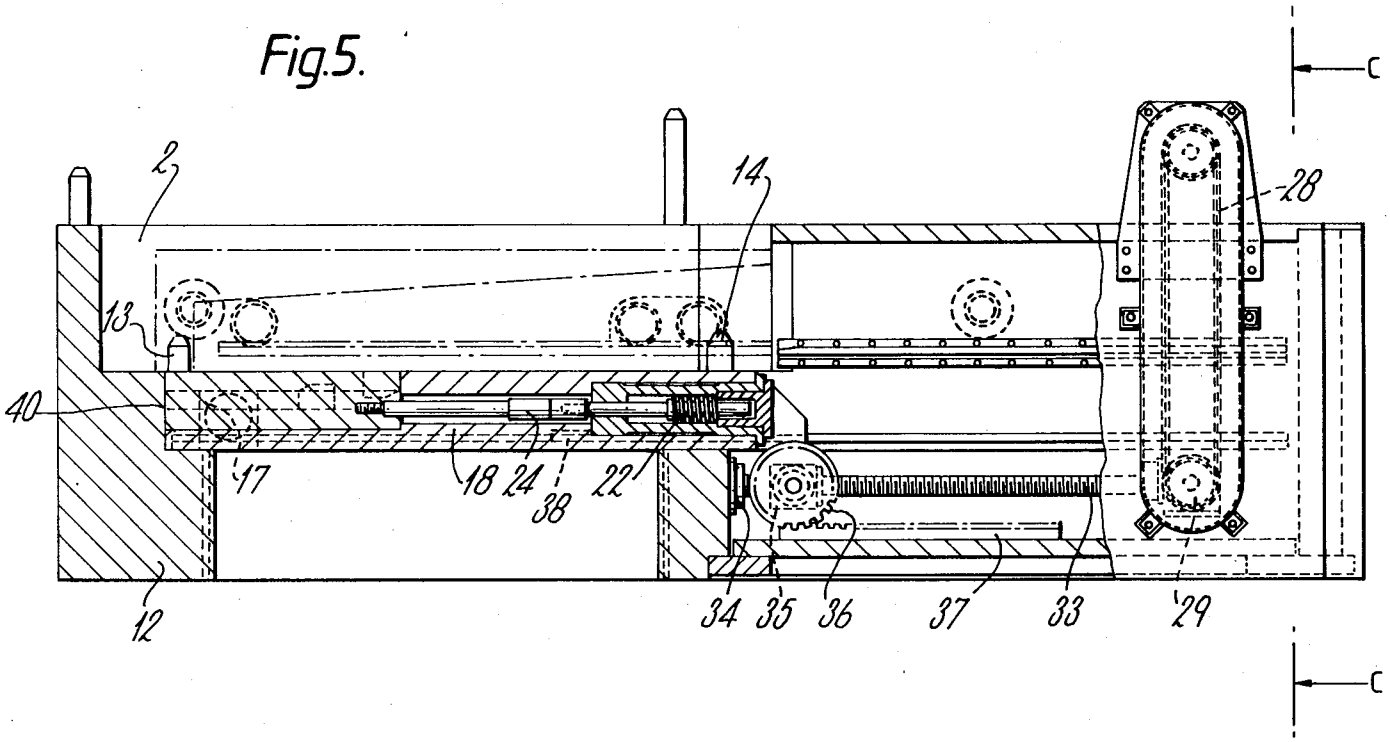
FIG. 5 is a sectional view of the gate installed in a housing and showing the flask door in phantom.
Figure 6:
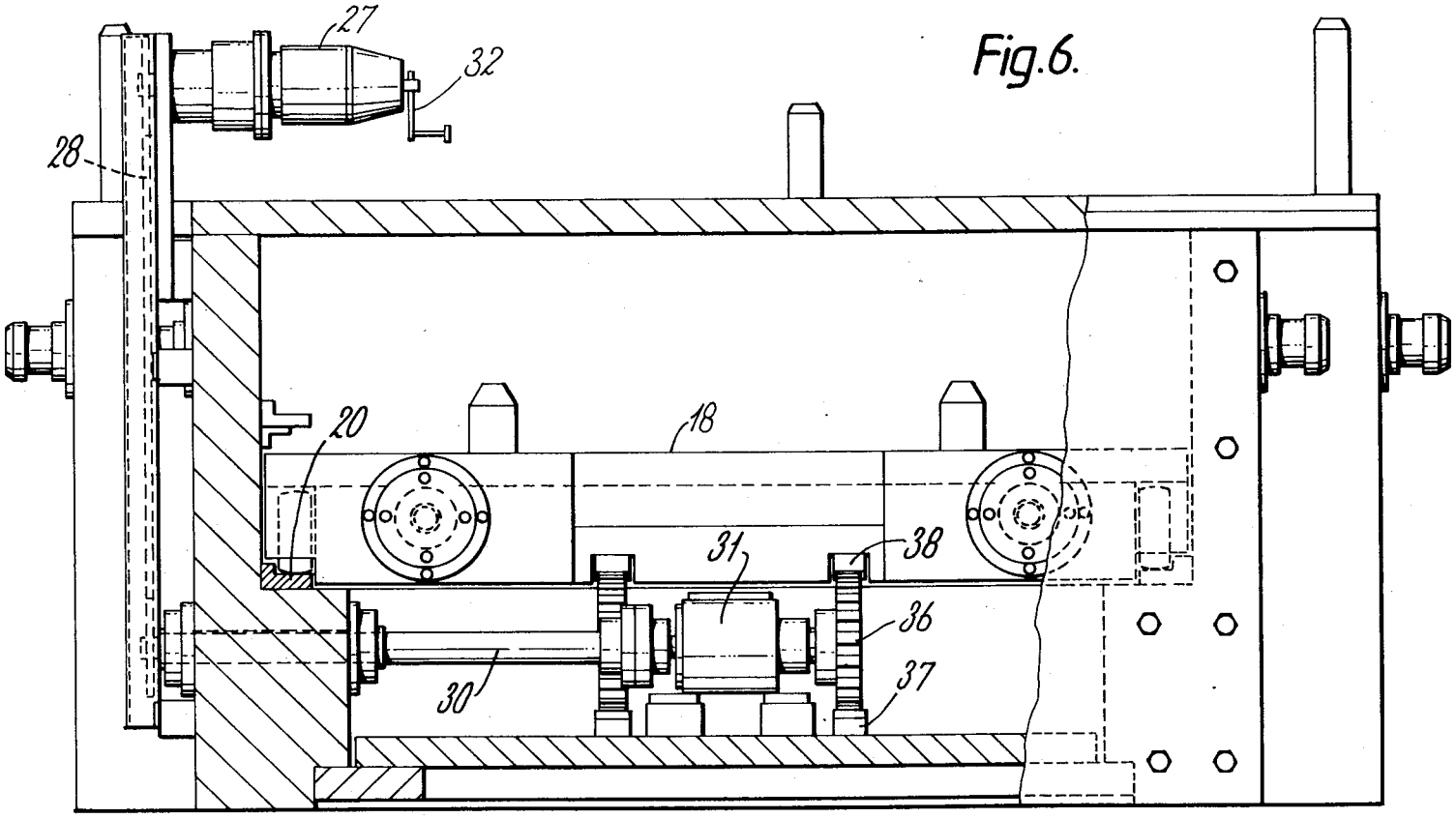
FIG. 6 is a section on C—C in FIG. 5.

The flask door 1 cooperates with a gate 11 (FIG. 4) which is mounted in a gate housing 12 (FIGS. 5 and 6). The flask base 2 containing the flask door 1 is received in the gate housing 12 and the door 1 mechanically interlocks with the gate 11 as a result of upstanding dowels 13, 14 on the gate which are received in mating dowel holes 15, 16 in the door. The gate 11 comprises two, co-planar, inter-leaved portions 17, 18 which are mounted on wheels 19 to run on rails 20 in the gate housing. Dowels 13 on the gate portion 17 cooperate with dowel holes 15 in the end of the upper wedge-shaped member 4 of the door 1. Dowels 14 on the gate portion 18 cooperate with dowel holes 16 in the lower wedge-shaped member 5 of the door 1.

The inter-leaved gate portions 17, 18 are urged apart by means of two spring loaded separation mechanisms 21, only one of which is shown in FIG. 4, positioned symmetrically at opposite sides of the centre line of the gate. Each mechanism 21 comprises a compression spring 22 contained within a housing 23 in the gate portion 18, the spring 22 acting on a plunger assembly 24 slidable in the portion 18 and secured at its end remote from the spring to the gate portion 17. Cooperating stops 25, 26 on each side of the respective gate portions 17, 18 limit the extent of the separation effected by the spring loaded separation mechanisms 21.

A drive mechanism for moving the gate and door assembly, the gate being coupled to the door by the dowels 13, 14 is shown in FIGS. 5 and 6. The drive mechanism comprises a drive motor 27 which is coupled through a chain 28 and sprocket 29 to the input shaft 30 of a bevel gear unit 31. The motor 27 can be provided with a manually operated handle 32 to enable the gate and door assembly to be moved in the event of a power failure. A lead screw 33 extends at 90° to the input shaft 30 from the bevel gear unit 31 to a journal 34 in the housing 12. The lead screw 33 imparts linear motion to a crosshead 35 supporting two pinions 36. The pinions 36 mesh with racks 37 fixed in the base of the gate housing 12 and with racks 38 located in channels 39 (FIG. 4) in the base of gate portion 18. The fixed racks 37 impart rotation to the pinions 36 which in turn, through the racks 38, effects displacement of the gate and door assembly. The arrangement is such that the linear displacement of the gate and door assembly is twice that of the pinions along the racks (compare FIG. 5 and FIG. 9).

Starting from a position at which the door 1 is in sealing engagement with the base 2 by virtue of the seal 8 cooperating with the sealing ring 9, the assembly operates in the following manner.

Actuation of the drive motor 27 effects linear displacement of the gate portion 18 and the separation of the gate portions 17 and 18. The spring loaded mechanisms 21, which can be adjustable, operate to urge the gate portion 17 away from the gate portion 18. Separation of the two gate portions proceeds until the stops 26 on the portion 18 abut against the stops 25 on the portion 17. Thereafter continued operation of the drive motor 27 causes the two gate portions to move together as a unit.

Figure 7:
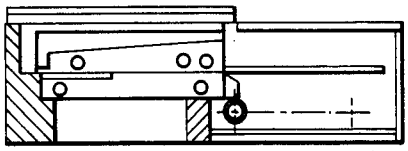
FIGS. 7 to 9 indicate diagrammatically stages in the operation of the door and gate assembly.
Figure 8:
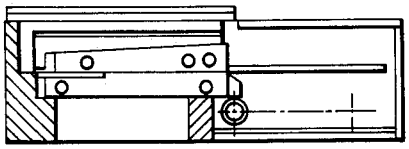
Figure 9:
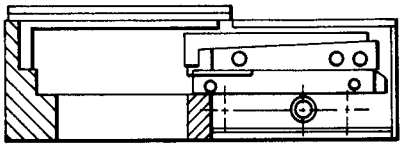

As the wedge-shaped door members 4 and 5 are fixedly secured to the gate portions 17 and 18 respectively by means of the dowels 13, 14 it follows that the door members move with the gate portions. The initial movement of the gate portion 18 effects similar movement of the lower wedge-shaped door member 5 to cause separation of the door members 4 and 5 at their inclined surfaces. Over this initial movement, the extent of which is determined by the positions of the stops 25 and 26, the gate portion 17 and the upper wedge-shaped door member 4 are stationary. The resulting gap created between the inclined surfaces of the now separated door members allows the upper door member 4 to fall vertically away from the flask base 2 thus breaking the seal therebetween. This initial movement therefore avoids relative sliding movement between the seal 8 and the sealing ring 9 which could result in scuffing and tearing of the seals. Thereafter the door members 4 and 5 move with the gate portions 17 and 18 into a fully open position to permit unimpeded access through the gate housing 12 into a flask located on the housing. FIGS. 7 to 9 depict the sequence of movements of the door and gate assembly between a fully closed position (FIG.7); an intermediate position at which the seals break (FIG. 8); and a fully open position (FIG. 9).

To close and seal a flask the drive motor is reversed to return the door and gate assembly. The gate portions 17 and 18 and the respective door members 4 and 5 are maintained separated by the spring loaded mechanisms 21 until the leading end of the upper door member 4 abuts against the stop face of the base 2. At the same time the leading end of the gate portion 17 abuts against face 40 of the gate housing 12. Continued movement of the gate portion 18 overcomes the spring loaded mechanisms 21 to close the gap between the portions 17 and 18 and the portions 18 finally abuts against the gate portion 17. The lower door member 5 moves with the gate portion 18 and in so doing it displaces the upper door member 4 vertically upwards to effectively bring the seal 8 into sealingly engagement with the sealing ring 9 in the flask base 2.

We claim:

1. An end closure for a container, in particular an end closure for a nuclear fuel transport flask, comprising means defining an end opening for a container, a gate movable laterally across said end opening between open and closed positions, the gate having first and second portions and means continuously urging said portions apart, a door, means releasably mounting the door on the gate, the door including means sealingly engageable with said opening, the door having upper and lower cooperable wedge-shaped members releasably mounted on the first and second gate portions respectively for movement therewith between the open and closed positions, the assembly including means arranged such that a lateral displacement of the gate into or out of its fully closed position effects movement of the second gate portion only and corresponding movement of the associated lower wedge-shaped door member, with the first gate portion and its associated upper wedge-shaped door member remaining laterally stationary whereby to effect a vertical displacement of the upper wedge-shaped door member into or out of sealing engagement with said opening.

2. An end closure according to claim 1 including respective cooperable stop members on the first and second gate portions to determine the extent of sole movement of the second gate portion independently of the first gate portion.

3. An end closure according to claim 1 wherein said sealingly engageable means includes a first sealing ring in the upper wedge-shaped door member, and further comprising a second sealing ring about said opening cooperable with the first sealing ring.

4. An end closure according to claim 1 wherein said continuous urging means includes spring-loaded means for continuously urging apart the first and second gate portions.

5. An end closure according to claim 4 in which the spring-loaded means comprises a pair of spring-loaded mechanisms positioned symmetrically at opposite sides of the centre line of the gate, each mechanism having a compression spring in one of the gate portions and a plunger slidable in said gate portion and secured at its end remote from the spring to the other of the gate portions.

* * * * *